US008291959B2

(12) United States Patent
Cheng

(10) Patent No.: US 8,291,959 B2
(45) Date of Patent: Oct. 23, 2012

(54) ROMAN SHADE

(76) Inventor: Li-Ming Cheng, Kaohsiung (TW)

( * ) Notice: Subject to any disclaimer, the term of this patent is extended or adjusted under 35 U.S.C. 154(b) by 140 days.

(21) Appl. No.: 12/886,573

(22) Filed: Sep. 21, 2010

(65) Prior Publication Data

US 2012/0067527 A1 Mar. 22, 2012

(51) Int. Cl.
*E06B 9/56* (2006.01)
*A47H 5/00* (2006.01)

(52) U.S. Cl. ..... 160/84.01; 160/89; 160/170

(58) Field of Classification Search ..... 160/84.01, 160/84.02, 84.04, 170, 23.1, 314, 313, 309, 160/121.1
See application file for complete search history.

(56) References Cited

U.S. PATENT DOCUMENTS

| | | | | |
|---|---|---|---|---|
| 5,813,447 | A | 9/1998 | Lysyj | |
| 6,257,300 | B1 * | 7/2001 | Brownlie | 160/84.01 |
| 6,497,267 | B1 * | 12/2002 | Azar et al. | 160/310 |
| 6,536,503 | B1 * | 3/2003 | Anderson et al. | 160/170 |
| 8,002,012 | B2 * | 8/2011 | Cheng | 160/170 |
| 8,066,050 | B2 * | 11/2011 | Lin | 160/84.04 |
| 2004/0144500 | A1 * | 7/2004 | Nien | 160/170 |
| 2005/0205216 | A1 * | 9/2005 | Vrielink | 160/23.1 |
| 2006/0144527 | A1 * | 7/2006 | Toti | 160/170 |
| 2007/0261798 | A1 * | 11/2007 | Hung et al. | 160/170 |
| 2008/0087386 | A1 * | 4/2008 | Nien et al. | 160/170 |
| 2010/0006236 | A1 * | 1/2010 | Liang et al. | 160/170 |
| 2010/0269985 | A1 * | 10/2010 | Hanley et al. | 160/84.04 |
| 2010/0294438 | A1 * | 11/2010 | Kirby et al. | 160/84.04 |
| 2011/0186240 | A1 * | 8/2011 | Lin | 160/84.01 |
| 2011/0192550 | A1 * | 8/2011 | Williams, III | 160/84.04 |
| 2012/0067527 | A1 * | 3/2012 | Cheng | 160/84.02 |

* cited by examiner

*Primary Examiner* — Blair M. Johnson
(74) *Attorney, Agent, or Firm* — Muncy, Geissler, Olds & Lowe, PLLC

(57) ABSTRACT

A Roman shade includes an upper rail, a Roman shade assembly attached to a lower side of the upper rail that is pendent and foldable, and a rolling shade retractable in the upper rail and retained at the backside of the Roman shade assembly. The Roman shade assembly includes a fabric shade, and the fabric shade has at least one pressing rod on the backside and a positioning means at a distal end. The rolling shade includes a main shaft in the upper rail with a winding means and a shade surface. The shade surface has one end fastened to the main shaft and another end running through the pressing rods and anchored on the positioning means. The winding means can be used to reduce a holding space and retraction and extension of the Roman shade can be controlled by the rolling shade. Operation is simpler with less effort.

7 Claims, 7 Drawing Sheets

ROMAN SHADE

FIELD OF THE INVENTION

The present invention relates to a Roman shade and particularly to a Roman shade equipped with a winding means for reducing a holding space and a retractable and extendable rolling shade to facilitate control of retraction and extension thereof.

BACKGROUND OF THE INVENTION

Window covering mainly is installed on a window to block sunshine and provides an ornamental function. To meet varying use requirements of consumers, myriad types of window coverings have been introduced on the market, such as Roman shades, Venetian blinds and the like. Control methods of Roman shades can be divided into one with cords to control retraction and extension and another one disclosed in U.S. Pat. No. 5,813,447 shown in FIGS. 1 and 2. Refer to FIGS. 1 and 2, the Cellular shade 1 mainly includes an upper rail 11 holding an automatic winding means 12 inside and a fabric shade 2 located at the bottom thereof, and the fabric shade 2 has two corresponding bracing blades 21 at two sides. Each bracing blade 21 has a plurality of apertures 22 latched with the fabric shade 2. The fabric shade 2 has a bottom end fastened to a lower rail 3 at the lowest side.

The automatic winding means 12 held in the upper rail 11 consists of a great number of elements, is difficult to fabricate and occupies a great deal of space. As a result, it needs a thicker shaft 121 and requires a greater internal space of the upper rail 11 for holding the great number of elements while winding the Cellular shade 1. The apertures 22 on the bracing blades 21 aim to latch with the fabric shade 2 to facilitate balance of retraction or extension of the fabric shade 2 at two sides. When a user grips the lower rail 3 to move upwards or pull downwards incorporating with the automatic winding means 12, the fabric shade 2 is wound or extended. It is a troublesome operation. There is still room for improvement in terms of usability.

SUMMARY OF THE INVENTION

The primary object of the present invention is to overcome the aforesaid shortcomings of the conventional Roman shade by providing an improved Roman shade that has a winding means for reducing a holding space and a retractable and extendable rolling shade to facilitate control of retraction and extension thereof.

The Roman shade according to the invention includes an upper rail, a Roman shade assembly attached to a lower side of the upper rail that is pendent and foldable, and a rolling shade retractable in the upper rail and retained on a backside of the Roman shade assembly. The Roman shade assembly includes a fabric shade which has at least one pressing rod at the backside of the fabric shade and a positioning means at a distal end thereof. The rolling shade includes a main shaft hinged on the upper rail having a winding means and a shade surface. The shade surface has one end fastened to the main shaft and another end run through by the pressing rods and fastened to the positioning means.

The Roman shade thus formed provides many advantages, notably:

1. Improved retraction and extension of the Roman shade: The rolling shade at the backside of the Roman shade assembly serves as a force application point. The positioning means at the backside of the rolling shade and a set of anchor means at two lower sides of the backside of the Roman shade assembly are coupled together to effectively drive the Roman shade assembly to wind upwards or extend downwards, thus control of retraction and extension of the Roman shade is much easier.

2. Greater usability: With the main shaft in the upper rail is served as a center and the winding means can perform retraction and extension, a user can hold the distal end of the Roman shade assembly to facilitate retraction and extension of the Roman shade assembly.

3. Enhanced safety: Retraction and extension of the Roman shade is controlled instantly without cords. Compared with the conventional Roman shades relied on cords for retraction and extension, the invention provides improved safety when in use.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
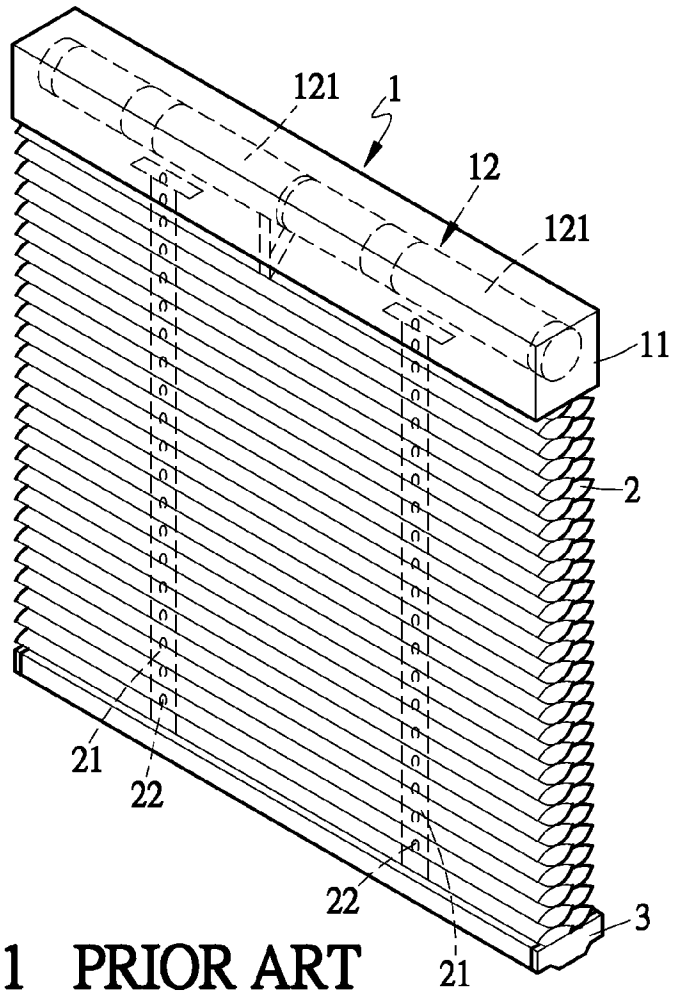
Fig.1 PRIOR ART
FIG. 1 is a perspective view of a control method of a Roman shade disclosed in U.S. Pat. No. 5,813,447.
Figure 2:
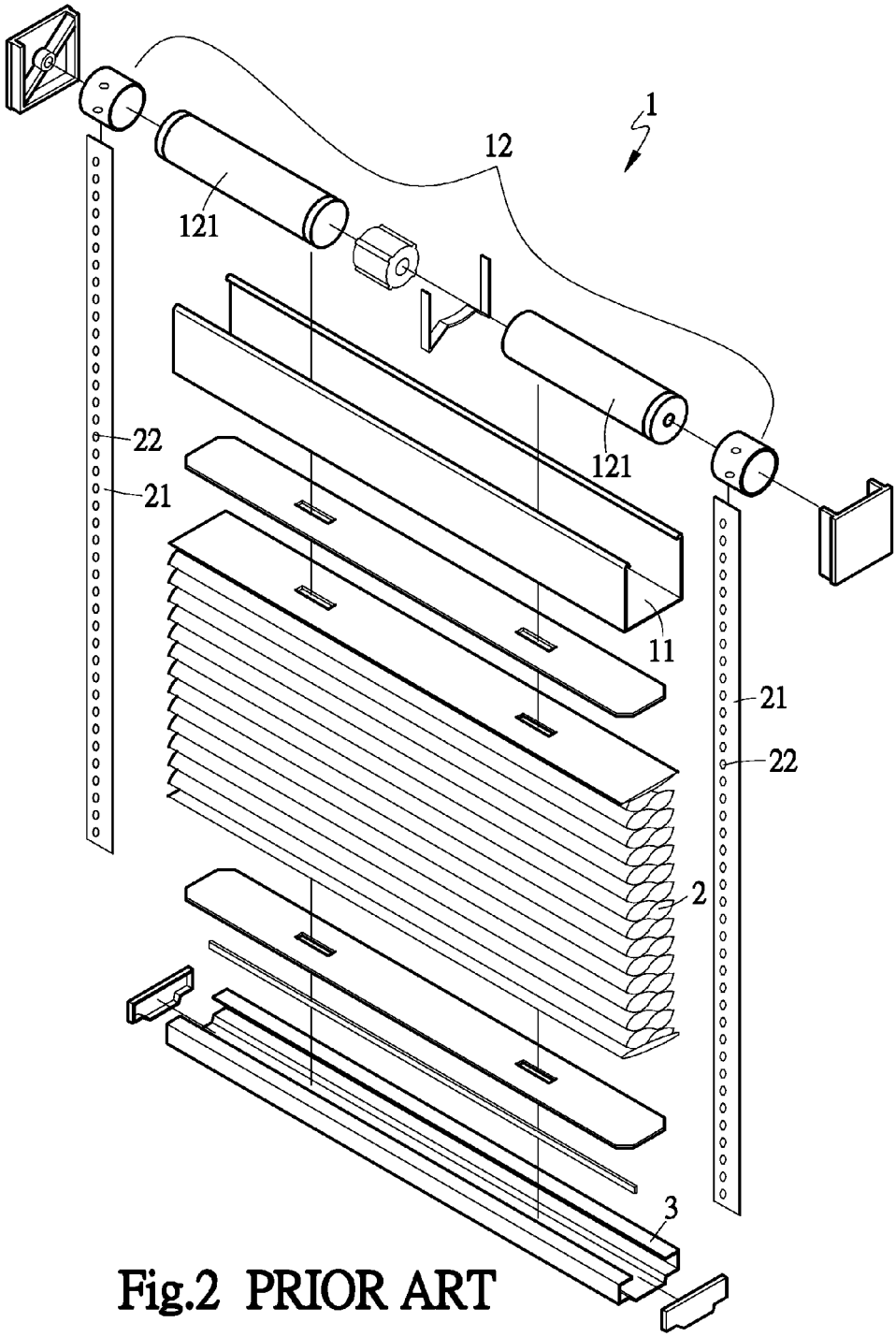
Fig.2 PRIOR ART
FIG. 2 is an exploded view according to FIG. 1.

Refer to FIGS. 3 through 6, the present invention provides a Roman shade 4 which includes an upper rail 5 transversely mounted onto a wall, a Roman shade assembly 6 attached to a lower side of the upper rail 5 that is pendent and foldable and close to a window, and a rolling shade 7 located below the upper rail 5 and retained on a backside of the Roman shade assembly 6.

The upper rail 5 has an upward opening, a housing space 51, and a slot 511 at the bottom end communicating with the housing space 51. It also holds a shaft holder 512 and an anchor seat 515 close to two outer sides of the slot 511. The shaft holder 512 has two latch notches 513 at two sides corresponding to each other and a plurality of fastening holes 514 at the bottom to receive fastening elements 5141 to fasten the shaft holder 512 to one end of the housing space 51. The anchor seat 515 has an anchor notch 516 at one side and a plurality of anchor holes 517 at the bottom to receive anchor elements 518 to anchor the anchor seat 515 to an opposite end of the housing space 51.

The Roman shade assembly 6 includes a fabric shade 61 fastened and perpendicular to the upper rail 5 through a holding member 610. The fabric shade 61 has at least one pressing rod 62 at the backside and a positioning means 64 at the lower side of a lowest pressing rod 63. There are two anchor means 65 at two lower sides of the positioning means 64 and a lower rail 66 at a distal end of the fabric shade 61.

The fabric shade 61 has a first fixed section 611 fastened to an outer side of the upper rail 5 through the holding member 610 in a vertical manner, and a second fixed section 612 connected to a rear end of the first fixed section 611. In embodiments of the invention, the total pendent length of the fabric shade 61 depends on the height of the window, and is generally greater than or equal to the height of the window.

In an embodiment of the invention, the pressing rod 62 confines threading of the rolling shade 7 and usually contains more than one attached to the backside of the fabric shade 61 in a spaced manner. The pressing rod 62 has a slot 620 coupled with the rolling shade 7. The pressing rod 62 and the lowest pressing rod 63 are constructed in the same way to be threaded through by the rolling shade 7.

The positioning means 64 aims to clamp the rolling shade 7, and is generally fastened to the lowest pressing rod 63 at the backside of the fabric shade 61 and the distal end of the fabric shade 61. It can be constructed in many ways, such as a clamp clip incorporating with a rod that is known in the art, details are omitted herein.

In an embodiment of the invention, the anchor means 65 is positioned at two sides between the distal end of the fabric shade 61 and lower rail 66. It includes a retaining bar 651 and two double latch clips 652. Each double latch clip 652 has two apertures 653 on two opposite sides to clip two ends of the retaining bar 651.

In an embodiment of the invention, the lower rail 66 may thread through the distal end of the fabric shade 61 via a rod with pendent weight to make the distal end of the fabric shade 61 in a pendent manner.

In an embodiment of the invention, the rolling shade 7 includes a main shaft 71 hinged in the upper rail 5 having a winding means 8 and a shade surface 76. The main shaft 71 is coupled transversely with the shaft holder 512 and anchor seat 515 in the housing space 51, and includes a bar 72, a transmission bar 73, an auxiliary bar 74 and a seal cap 75. The bar 72 is a hollow bar. The transmission bar 73 is formed in a rectangular shape to run through the bar 72, auxiliary bar 74 and seal cap 75. The auxiliary bar 74 has two anchor members 741 at two sides to be latched to outer sides of the latch notches 513 of the shaft holder 512, and a first protrusion member 742 and a second protrusion member 743 on outer sides of the two anchor members 741. The first protrusion member 742 is coupled with one end 721 of the bar 72. The second protrusion member 743 is formed in a rectangular shape. The seal cap 75 has a protrusion 751 at one end coupled with one end 722 of the bar 72 and a protrusion 752 at another end anchored on the anchor notch 516 of the anchor seat 515. The shade surface 76 has one end located at the main shaft 71 in the upper rail 5 and another end being retractable and running through the pressing rods 62 and 63 at the backside of the fabric shade 61 and fastened to the positioning means 64.

The winding means 8 includes an upper seat 81 and a lower seat 82 coupled together, a first holding strut 821 and a second holding strut 822 located in a housing compartment of the lower seat 82, a first elastic winding spool 83 and a second elastic winding spool 84 coupled on the first and second holding struts 821 and 822, a first gear 831 fastened to a distal end of the first holding strut 821, an elastic reed 85 with two wedge ends 851 and 852 latched on the first and second elastic winding spools 83 and 84, a third holding strut 823 located close to an inner side of the housing compartment of the lower seat 82 with a second gear 86 coupled thereon to engage with the first gear 831 and a bevel gear 861 located thereon, and a bevel gear element 87 coupled at one side of the upper and lower seats 81 and 82 to engage with the bevel gear 861 for transmission. The bevel gear element 87 has a cavity 871 at one end hinged by the transmission bar 73 to form synchronous rotation therewith, also to drive the bevel gear 861 and second gear 86 to rotate, then the first gear 831 also is driven to rotate, thereby the first and second elastic winding spools 83 and 84 can be loosened to move forwards or backwards or pressed for anchoring, and the elastic reed 85 also is retracted or extended to allow the Roman shade 4 to be retracted or extended to a selected position.

Figure 3:
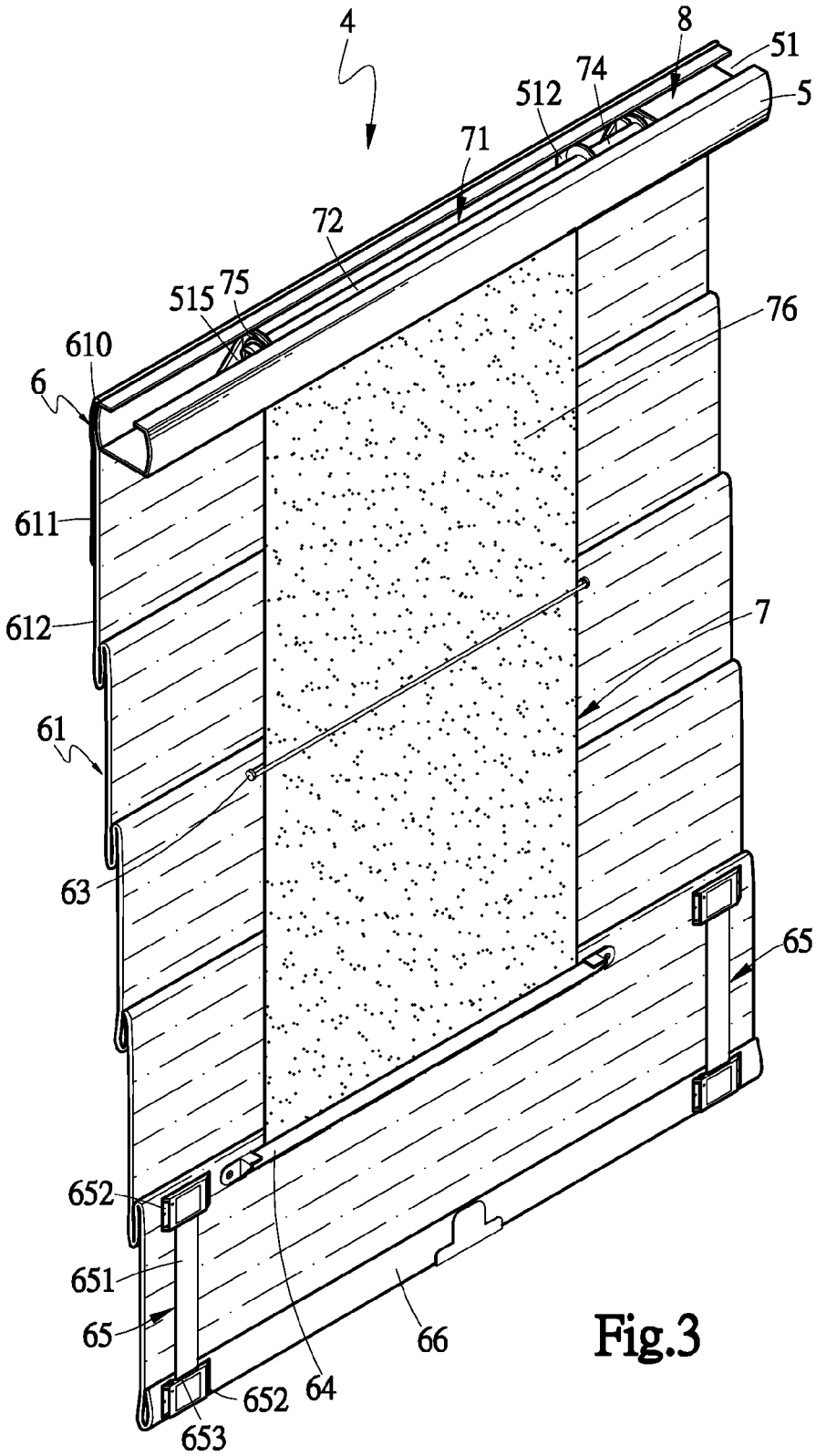
FIG. 3 is a rear perspective view of the Roman shade of the invention.
Figure 4:
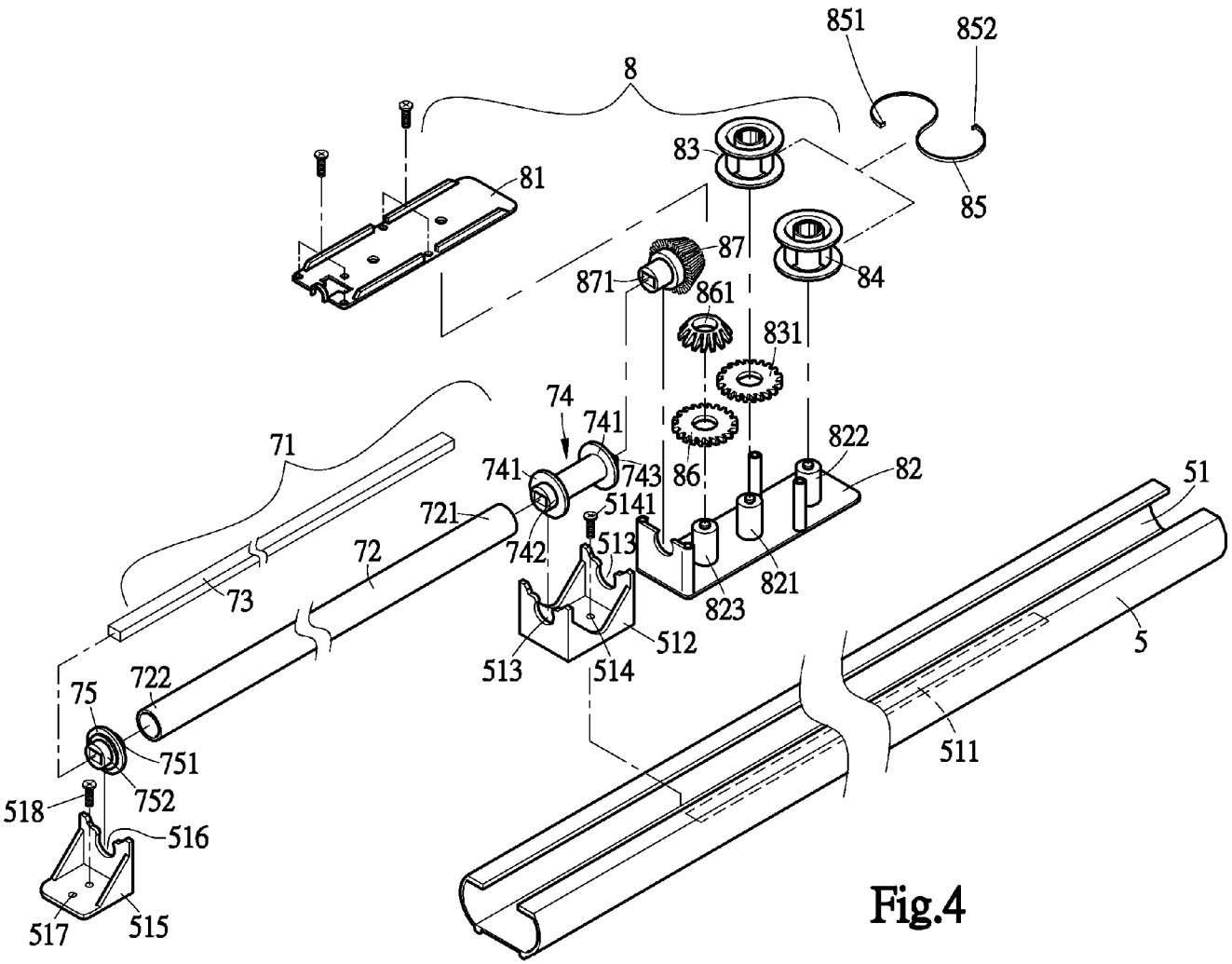
FIG. 4 is an exploded view of the upper rail and rolling shade according to FIG. 3.
Figure 5:
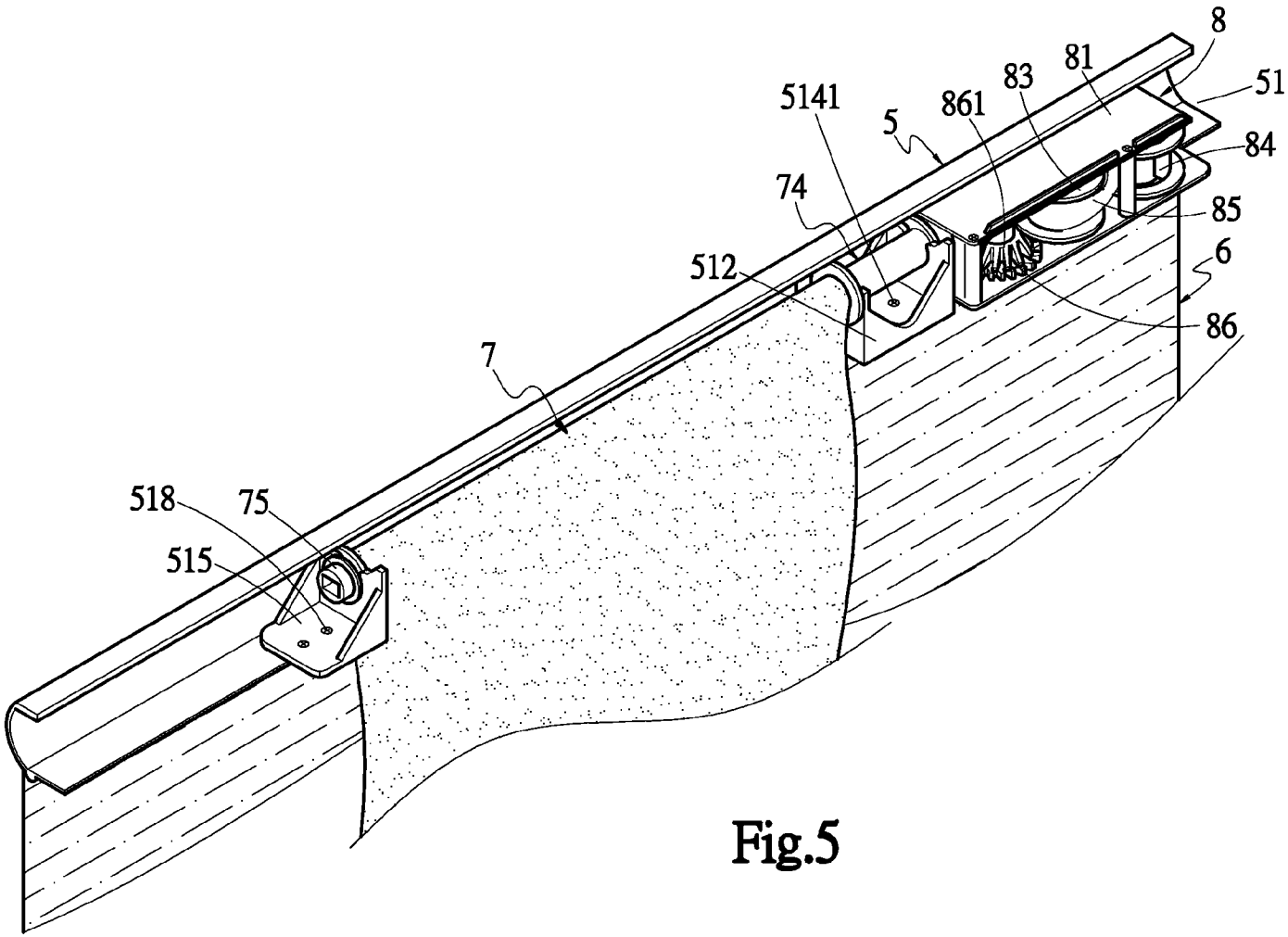
FIG. 5 is a perspective view of the upper rail and rolling shade according to FIG. 3.

FIG. 3 shows an embodiment of the Roman shade 4 in a condition that fully blocks sunshine. The fabric shade 61 and rolling shade 7 are fully pendent, i.e. the extended distal end of the rolling shade 7 is clamped on the positioning means 64 at the backside of the fabric shade 61. The fabric shade 61 is retracted and extended by retraction and extension movements of the rolling shade 7 (referring to FIGS. 6 and 7).

Figure 6:
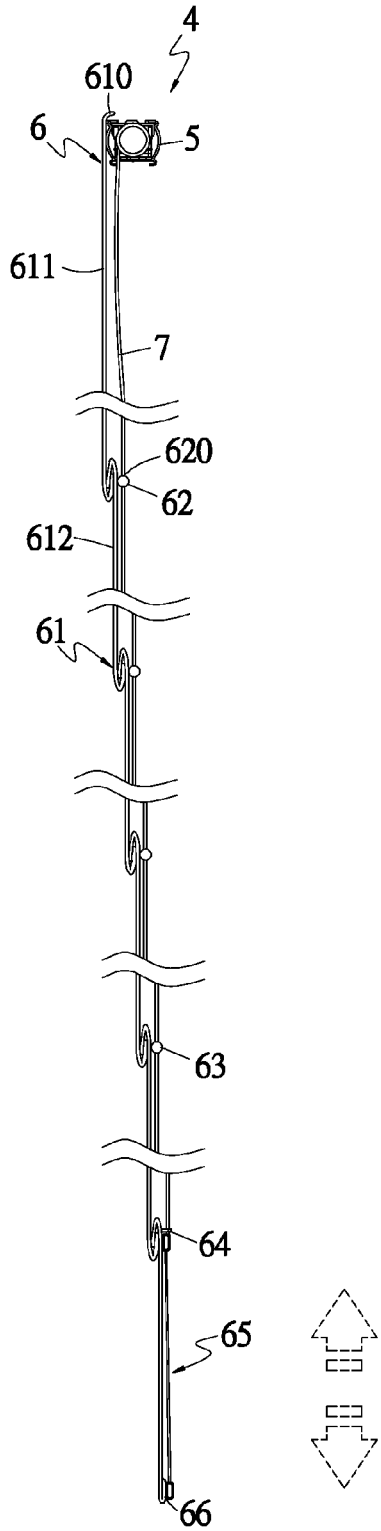
FIG. 6 is a schematic view of the fabric shade of the invention in a retracting or extending condition.
Figure 7:
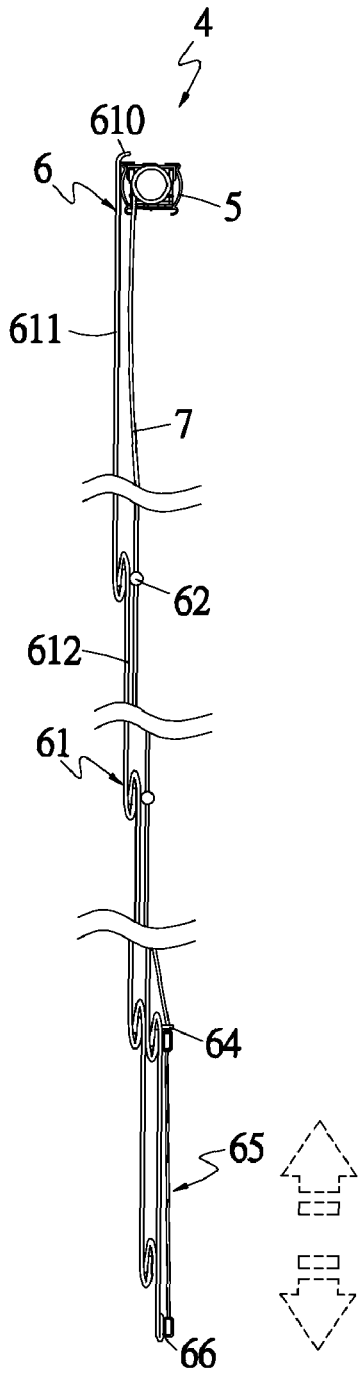
FIG. 7 is another schematic view of the fabric shade of the invention in a retracting or extending condition.

Also referring to FIG. 6, when retracting or extending the fabric shade 61 is desired, the rolling shade 7 can be moved upwards through the positioning means 64 in a folded manner. The user can grip the distal end of the fabric shade 61 and move the fabric shade 61 upwards. Through the distal end of the rolling shade 7 at the backside of the fabric shade 61 and the anchor means 65 at the bottom of the Roman shade 4, and the automatic winding function of the winding means 8 and the upward lifting of the rolling shade 7, the fabric shade 61 can be synchronously moved upwards in a folded manner to form fully retraction (referring to FIG. 7). When extension of the Roman shade 4 is desired, holding the distal end of the fabric shade 61 and moving downwards, and by incorporating with the winding means 8 and related elements, the extension can be accomplished. During retraction of the fabric shade 61, by incorporating with the pressing rods 62 and 63 running through the rolling shade 7 that provides a guiding and folding function, retraction of the fabric shade 61 can be performed more smoothly. Moreover, the shade surface 76 of the rolling shade 7 can be formed in a mesh fashion. When sunshine passes through the Roman shade 4, shadow of the rolling shade 7 cannot be seen from the front side of the Roman shade 4. Thus practicability of the Roman shade 4 improves.

What is claimed is:

1. A Roman shade, comprising:

an upper rail including a housing space to hold a shaft holder and an anchor seat;

a Roman shade assembly including a foldable and pendent fabric shade fastened to a lower side of the upper rail and at least one pressing rod on a backside of the fabric shade and a positioning means below a lowest pressing rod; and a rolling shade including a main shaft located in the upper rail with a winding means and a shade surface which includes one end fastened to the main shaft and another end running through the pressing rods and clamped by the positioning means;

wherein the winding means includes an upper seat and a lower seat coupled together, a first holding strut and a second holding strut located in a housing compartment of the lower seat, a first elastic winding spool and a second elastic winding spool coupled on the first and second holding struts, a first gear coupled on a distal end of the first holding strut, an elastic reed coupled on the first and second elastic winding spools that includes two wedge ends latched thereon, a third holding strut located close to an inner side of the housing compartment of the lower seat and a second gear coupled thereon to engage with the first gear and a bevel gear located thereon, and a bevel gear element coupled at one side of the upper and lower seats to engage with the bevel gear for transmission to allow the winding means to retract or extend the rolling shade.

2. The Roman shade of claim 1, wherein the upper rail includes an upward opening and a slot at the bottom communicating with the housing space, the shaft holder including latch notches at two sides corresponding to each other and a plurality of fastening holes at the bottom to receive fastening elements to fasten the shaft holder to one end of the housing space, the anchor seat including an anchor notch at one side and a plurality of anchor holes at the bottom to receive anchor elements to anchor the anchor seat to another opposite end of the housing space.

3. The Roman shade of claim 1, wherein the pressing rods are attached to the backside of the fabric shade in a spaced manner, and each pressing rod includes a slot to allow the fabric shade to thread through for positioning.

4. The Roman shade of claim 1, wherein the main shaft includes a bar, a transmission bar, an auxiliary bar and a seal cap.

5. The Roman shade of claim 4, wherein the bar is a hollow bar, the transmission bar being formed in a rectangular shape to run through the bar, auxiliary bar and seal cap, the auxiliary bar including two anchor members at two sides to be latched on the shaft holder, and the two anchor members including a first protrusion member and a second protrusion member on outer sides thereof; the first protrusion member being coupled with one end of the bar, the second protrusion member being formed in a rectangular shape, the seal cap including a protrusion at one end coupled with another end of the bar and a strut at another end thereof anchored on the anchor seat.

6. The Roman shade of claim 1, wherein the fabric shade includes a first fixed section and a second fixed section connected to the first fixed section.

7. The Roman shade of claim 1, wherein the shade surface of the rolling shade is formed in a mesh fashion.

* * * * *